US012704062B2

(12) United States Patent
Shetty et al.

(10) Patent No.: US 12,704,062 B2
(45) Date of Patent: Aug. 11, 2026

(54) WELL CONNECTIVITY ANALYSIS USING PRESSURE PULSE

(71) Applicant: Halliburton Energy Services, Inc., Houston, TX (US)

(72) Inventors: Dinesh Ananda Shetty, Houston, TX (US); Erik Lee, Houston, TX (US); Derek Shelby Bale, Houston, TX (US); Rajani Prakash Satti, Houston, TX (US); Zhijie Sun, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/920,483

(22) Filed: Oct. 18, 2024

(65) Prior Publication Data

US 2025/0369348 A1 Dec. 4, 2025

Related U.S. Application Data

(60) Provisional application No. 63/654,764, filed on May 31, 2024, provisional application No. 63/653,286, filed on May 30, 2024.

(51) Int. Cl.
*E21B 47/12* (2012.01)
*E21B 43/26* (2006.01)

(52) U.S. Cl.
CPC ..... *E21B 47/12* (2013.01); *E21B 43/26* (2013.01)

(58) Field of Classification Search
CPC ..... E21B 43/26; E21B 47/06; E21B 49/00; E21B 47/12
See application file for complete search history.

(56) References Cited

U.S. PATENT DOCUMENTS

| | | | |
|---|---|---|---|
| 4,899,320 | A | 2/1990 | Hearn et al. |
| 4,993,491 | A | 2/1991 | Palmer et al. |
| 5,295,393 | A | 3/1994 | Thiercelin |
| 5,441,340 | A | 8/1995 | Cedillo et al. |
| 6,439,310 | B1 | 8/2002 | Scott, III et al. |
| 6,795,773 | B2 | 9/2004 | Soliman et al. |

(Continued)

FOREIGN PATENT DOCUMENTS

| | | | |
|---|---|---|---|
| CA | 3221947 A1 * | 1/2018 | ..... E21B 47/06 |
| CA | 3034253 | 1/2021 | |

(Continued)

OTHER PUBLICATIONS

"U.S. Appl. No. 16/668,791 Final Office Action", Jul. 12, 2021, 14 pages.

(Continued)

*Primary Examiner* — Zakiya W Bates
(74) *Attorney, Agent, or Firm* — DeLizio, Peacock, Lewin and Guerra, LLP

(57) ABSTRACT

A method comprises inducing, via one or more hydraulic fracturing components, a first signal in hydraulic fracturing fluid in a treatment well while hydraulically fracturing the treatment well, wherein the treatment well is formed in a subsurface formation. The method comprises detecting, via one or more sensors, a response signal in one or more offset wells formed in the subsurface formation based on the first signal, wherein the response signal indicates well connectivity between the treatment well and the one or more offset wells.

19 Claims, 4 Drawing Sheets

(56) References Cited

U.S. PATENT DOCUMENTS

| | | | |
|---|---|---|---|
| 6,935,424 | B2 | 8/2005 | Lehman et al. |
| 7,210,528 | B1 | 5/2007 | Brannon et al. |
| 7,377,319 | B2 | 5/2008 | Patterson |
| 7,451,812 | B2 | 11/2008 | Cooper et al. |
| 7,451,820 | B2 | 11/2008 | Albers et al. |
| 7,516,793 | B2 | 4/2009 | Dykstra |
| 7,673,507 | B2 | 3/2010 | Walters et al. |
| 7,938,181 | B2 | 5/2011 | Dusterhoft et al. |
| 8,126,646 | B2 | 2/2012 | Grove et al. |
| 8,528,649 | B2 | 9/2013 | Kolle |
| 9,135,475 | B2 | 9/2015 | Lecerf et al. |
| 9,222,347 | B1 | 12/2015 | Walls et al. |
| 9,441,470 | B2 | 9/2016 | Guerrero et al. |
| 9,658,357 | B2 | 5/2017 | Kabannik et al. |
| 9,803,467 | B2 | 10/2017 | Tang et al. |
| 9,909,404 | B2 | 3/2018 | Hwang et al. |
| 10,001,769 | B2 | 6/2018 | Huang et al. |
| 10,400,550 | B2 | 9/2019 | Gu et al. |
| 10,408,029 | B2 | 9/2019 | Rodrigues et al. |
| 10,641,090 | B2 | 5/2020 | Felkl et al. |
| 10,677,961 | B1 | 6/2020 | Chen et al. |
| 10,689,971 | B2 | 6/2020 | Smith et al. |
| 10,995,609 | B2 | 5/2021 | Felki et al. |
| 11,199,084 | B2 | 12/2021 | Langnes et al. |
| 11,230,915 | B2 | 1/2022 | Dusterhoft et al. |
| 11,319,790 | B2 | 5/2022 | Potty et al. |
| 11,320,551 | B2 | 5/2022 | Liu et al. |
| 11,415,716 | B2 | 8/2022 | Clark et al. |
| 11,434,738 | B1 | 9/2022 | Han |
| 11,518,931 | B2 | 12/2022 | Duncan et al. |
| 11,608,740 | B2 | 3/2023 | Moos et al. |
| 11,649,696 | B2 | 5/2023 | Angman et al. |
| 11,668,168 | B2 | 6/2023 | Parsegov et al. |
| 11,702,931 | B2 | 7/2023 | Inyang et al. |
| 11,704,557 | B2 | 7/2023 | Moniruzzaman et al. |
| 11,708,759 | B2 | 7/2023 | Jaaskelainen et al. |
| 11,753,917 | B2 | 9/2023 | Shetty et al. |
| 11,753,923 | B2 | 9/2023 | Dalamarinis |
| 11,762,115 | B2 | 9/2023 | Quan et al. |
| 11,767,751 | B2 | 9/2023 | Coenen et al. |
| 11,808,145 | B2 | 11/2023 | Fripp et al. |
| 11,879,317 | B2 | 1/2024 | Hunter et al. |
| 12,006,819 | B2 | 6/2024 | Cramer |
| 12,037,899 | B2 | 7/2024 | Swan |
| 12,486,747 | B1 | 12/2025 | Jeremic et al. |
| 12,523,143 | B2 | 1/2026 | Chen et al. |
| 2006/0034152 | A1 | 2/2006 | Korneev et al. |
| 2007/0007003 | A1 | 1/2007 | Jackson et al. |
| 2010/0314104 | A1 | 12/2010 | Shokanov et al. |
| 2013/0079935 | A1 | 3/2013 | Kabannik et al. |
| 2014/0222392 | A1 | 8/2014 | Johnson et al. |
| 2016/0222741 | A1 | 8/2016 | Lovorn et al. |
| 2016/0266276 | A1 | 9/2016 | Stokely et al. |
| 2017/0138150 | A1 | 5/2017 | Yencho |
| 2017/0342823 | A1 | 11/2017 | V. et al. |
| 2018/0210105 | A1 | 7/2018 | Stokely |
| 2019/0029884 | A1 | 1/2019 | Jonkheere et al. |
| 2019/0129047 | A1 | 5/2019 | Clark et al. |
| 2019/0136684 | A1 | 5/2019 | Felkl et al. |
| 2019/0146115 | A1 | 5/2019 | Mayo et al. |
| 2019/0310386 | A1 | 10/2019 | Quan et al. |
| 2019/0338619 | A1 | 11/2019 | Bois |
| 2020/0063533 | A1 | 2/2020 | Annaiyappa |
| 2020/0308958 | A1 | 10/2020 | Kabannik et al. |
| 2021/0032967 | A1 | 2/2021 | Dusterhoft et al. |
| 2021/0040841 | A1 | 2/2021 | Dusterhoft et al. |
| 2021/0073342 | A1 | 3/2021 | Razavi et al. |
| 2021/0131254 | A1 | 5/2021 | Potty et al. |
| 2021/0140312 | A1 | 5/2021 | Dumoit et al. |
| 2021/0189874 | A1 | 6/2021 | Jaaskelainen et al. |
| 2021/0277760 | A1 | 9/2021 | Stephenson et al. |
| 2021/0301657 | A1 | 9/2021 | Gordon et al. |
| 2021/0302612 | A1 | 9/2021 | Venkatakrishnan et al. |
| 2021/0396117 | A1 | 12/2021 | Yeung et al. |
| 2021/0406792 | A1 | 12/2021 | Bhardwaj et al. |
| 2022/0120173 | A1 | 4/2022 | Balan et al. |
| 2022/0145742 | A1 | 5/2022 | Dalamarinis et al. |
| 2022/0186605 | A1 | 6/2022 | Quan et al. |
| 2022/0228484 | A1 | 7/2022 | Cramer |
| 2022/0307371 | A1 | 9/2022 | Swan |
| 2022/0325621 | A1 | 10/2022 | Moos et al. |
| 2022/0364429 | A1 | 11/2022 | Burke et al. |
| 2023/0009947 | A1 | 1/2023 | Ruhle et al. |
| 2023/0066612 | A1 | 3/2023 | Parsegov et al. |
| 2023/0086213 | A1 | 3/2023 | Yeung et al. |
| 2023/0120763 | A1 | 4/2023 | Ray |
| 2023/0147476 | A1 | 5/2023 | Wheelock et al. |
| 2023/0228185 | A1 | 7/2023 | Dunham et al. |
| 2023/0235635 | A1 | 7/2023 | Li et al. |
| 2023/0243231 | A1 | 8/2023 | Zakharia et al. |
| 2023/0296800 | A1 | 9/2023 | Zheng et al. |
| 2023/0383639 | A1 | 11/2023 | Sridhar et al. |
| 2023/0417940 | A1 | 12/2023 | Rose et al. |
| 2024/0060410 | A1 | 2/2024 | Gunaratne et al. |
| 2024/0077071 | A1 | 3/2024 | Mu et al. |
| 2025/0369324 | A1 | 12/2025 | Shetty et al. |
| 2025/0369325 | A1 | 12/2025 | Jeremic et al. |
| 2025/0369339 | A1 | 12/2025 | Shetty et al. |
| 2025/0369343 | A1 | 12/2025 | Chen et al. |
| 2025/0369345 | A1 | 12/2025 | Suh et al. |
| 2025/0369347 | A1 | 12/2025 | Shetty et al. |
| 2025/0369352 | A1 | 12/2025 | Shetty et al. |
| 2025/0370154 | A1 | 12/2025 | Bale et al. |
| 2025/0371224 | A1 | 12/2025 | Sun et al. |

FOREIGN PATENT DOCUMENTS

| | | | | |
|---|---|---|---|---|
| CA | 3034219 C | * | 3/2023 | ..... E21B 47/117 |
| CN | 114152977 | | 1/2023 | |
| WO | 2009096805 | | 8/2009 | |
| WO | 2018022044 | | 2/2018 | |
| WO | 2018084871 | | 5/2018 | |
| WO | 2018111231 | | 6/2018 | |
| WO | 2021061567 | | 4/2021 | |

OTHER PUBLICATIONS

"U.S. Appl. No. 16/668,791 Non Final Office Action", Mar. 2, 2021, 12 pages.

Carey, et al., "Analysis of Water Hammer Signatures for Fracture Diagnostics", SPE Annual Technical Conference and Exhibition, Sep. 28-30, 2015,, 2015, 25 pages.

Chen, et al., "Research on recognition and classification of pulse signal features based on EPNCC", Scientific Reports vol. 12, Article No. 6731 (2022), 2022, 11 pages.

Cramer, et al., "Integrating Distributed Acoustic Sensing, Treatment-Pressure Analysis, and Video-Based Perforation Imaging To Evaluate Limited-Entry-Treatment Effectiveness", SPE Production and Operations, vol. 35, Issue 04, Nov. 2020, 2020, 26 pages.

Cramer, "The Application of Limited-Entry Techniques in Massive Hydraulic Fracturing Treatments", SPE Production Operations Symposium held in Oklahoma City, Oklahoma, Mar. 8-10, 1987, 1987, 18 pages.

Crump, et al., "Effects of Perforation-Entry Friction on Bottomhole Treating Analysis", JPT vol. 40, Issue 08, Aug. 1988, 1988, 8 pages.

Dung, et al., "Practical Applications of Water Hammer Analysis from Hydraulic Fracturing Treatments", SPE Hydraulic Fracturing Technology Conference and Exhibition, Virtual, May 2021, Apr. 27, 2021, 47 pages.

Dunham, et al., "Constraints on Pipe Friction and Perforation Cluster Efficiency from WaterHammer Analysis", SPE Hydraulic Fracturing Technology Conference and Exhibition, The Woodlands, Texas, USA, Jan. 31-Feb. 2, 2023., 2023, 12 pages.

Kotthoff, "Algorithm Selection for Combinatorial Search Problems: A Survey", AI Magazine, 35 (3), 2014, 37 pages.

Long, et al., "A Perforation-Erosion Model for Hydraulic-Fracturing Applications", SPE Annual Technical Conference and Exhibition, Houston, Sep. 28-30, 2015, 2015, 15 pages.

Martins, et al., "Communication Models for Distributed Acoustic Sensing for Telemetry", IEEE Sensors Journal, vol. 17, No. 15, Aug. 1, 2017, 2017, 12 pages.

(56) References Cited

OTHER PUBLICATIONS

"PCT Application No. PCT/US2025/014878 International Search Report and Written Opinion", May 26, 2025, 10 pages.
"PCT Application No. PCT/US2025/014882 International Search Report and Written Opinion", May 28, 2025, 10 pages.
"PCT Application No. PCT/US2024/053767 International Search Report and Written Opinion", Feb. 21, 2025, 10 pages.
"PCT Application No. PCT/US2024/053772 International Search Report and Written Opinion", Feb. 20, 2025, 10 pages.
"PCT Application No. PCT/US2024/053866 International Search Report and Written Opinion", Feb. 21, 2025, 11 pages.
"PCT Application No. PCT/US2024/054478 International Search Report and Written Opinion", Feb. 20, 2025, 9 pages.
"PCT Application No. PCT/US2024/054614 International Search Report and Written Opinion", Feb. 20, 2025, 10 pages.
"PCT Application No. PCT/US24/53771 International Search Report and Written Opinion", Feb. 25, 2025, 10 pages.
"PCT Application No. PCT/US2024/053099 International Search Report and Written Opinion", Feb. 20, 2025, 9 pages.
"PCT Application Serial No. PCT/US24/54479, International Search Report and Written Opinion", Feb. 19, 2025, 11 pages.
"U.S. Appl. No. 18/919,064 Non-Final Office Action", Sep. 5, 2025, 7 pages.
"U.S. Appl. No. 18/920,381 Non-Final Office Action", Sep. 17, 2025, 11 pages.
"U.S. Appl. No. 18/920,567 Non-Final Office Action", Jul. 15, 2025, 11 pages.

* cited by examiner

WELL CONNECTIVITY ANALYSIS USING PRESSURE PULSE

TECHNICAL FIELD

This disclosure relation generally to the field of hydraulically fracturing a wellbore in a subsurface formation and more particular to the field of well interference when hydraulically fracturing a wellbore.

BACKGROUND

In hydrocarbon recovery operations, fluid and sand may be pumped into a wellbore to hydraulically fracture a subsurface formation. The pump rate and pressure from the fluid may fracture the subsurface formation, creating a conduit for the fluid in the subsurface formation to flow to the wellbore and ultimately to the surface. Sand may be pumped with the fluid and placed into the fractures to support said fractures. A wellbore may be hydraulically fractured in one or more stages, where each stage includes clusters of perforations in which the fluid and sand may enter the subsurface formation to fracture said subsurface formation. One or more wellbores may be drilled in the same subsurface formation. In some instances, the fractures generated in the rock from hydraulic fracturing operations on a well may induce hydraulic communication between the well and one or more offset wells in the same subsurface formation.

BRIEF DESCRIPTION OF THE DRAWINGS

Implementations of the disclosure may be better understood by referencing the accompanying drawings.

DESCRIPTION

Figure 1:
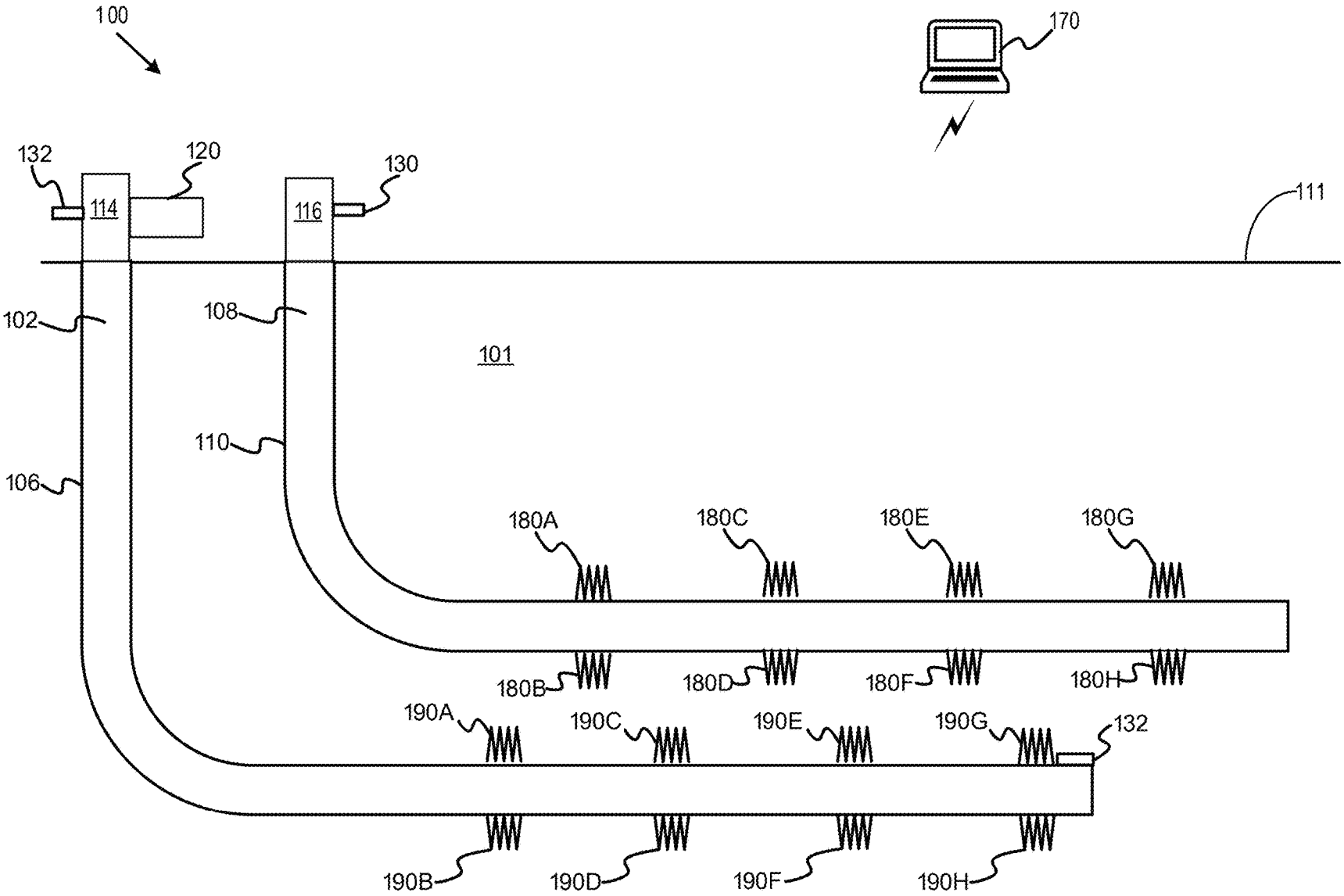
FIG. 1 is an illustration depicting an example multi-well system, according to some implementations.

The description that follows includes example systems, methods, techniques, and program flows that embody aspects of the disclosure. However, it is understood that this disclosure may be practiced without these specific details. For instance, this disclosure refers to determining well connectivity between a treatment well and an offset well with a pressure pulse. Aspects of this disclosure can also be applied to continuously and/or intermittently inducing pressure pulses throughout the hydraulic fracturing process of a treatment well. For clarity, some well-known instruction instances, protocols, structures, and operations have been omitted.

Example implementations relate to utilized pressure pulses to infer well connectivity and hydraulic fracturing properties during hydraulic fracturing operations. Multiple wells may be drilled in a common subsurface formation. During the hydraulic fracturing operations of a well (i.e., a treatment well), one or more offset wells may experience well connectivity (i.e., frac-hit) from the hydraulic fracturing operations on the treatment well. For example, a field may include a parent well that may already be completed (i.e., hydraulically fractured and in production) and a child well (not yet completed). When the child well is being hydraulically fractured, hydraulic communication may be established between the child well and the parent well. The hydraulic communication may affect the bottom hole pressure of the parent well, production flow rate, etc. Well connectivity between wells may occur in other instances such as during zipper frac operations, simulfrac operations, etc. Well connectivity may result in negative impacts to the hydraulic fracturing operations and ultimately production of hydrocarbons from the subsurface formation for both the treatment well and the offset wells. For example, well interference may result in a loss of hydraulic fracturing fluid to depleted zones in the formation. Accordingly, the hydraulic fluid being pumped may not be utilized to generate fractures in the rock, resulting in a decrease in hydraulic fracturing efficiency. Moreover, the hydraulic fracturing fluid may decrease the production rates in offset wells when flowing to the depleted zones.

In some implementations, well connectivity of a treatment well and one or more offset wells and fracture system properties between said wells may be inferred with the utilization of pressure pulses. A signal (such as a pressure pulse) may be induced in a treatment well during hydraulic fracturing operations of the treatment well. For example, the signal may be generated by a decrease in rate, initiated by one or more pumps (frac pumps), for a period of time when a stage of the treatment well is being hydraulically fractured. Any suitable form method and/or component may be utilized to generate the pressure signal. One or more sensors, such as a pressure sensor, may be positioned at the surface of the treatment well and offset wells (or any other suitable position proximate the offset wells). A time series of pressure data from the treatment well and offset wells may be recorded when the signal is induced on the treatment well. When a pressure signature (i.e., a response signal) is generated in the pressure data of one or more offset wells, it may indicate well connectivity between the treatment well and the respective offset well. For example, a stage of a treatment well may be hydraulically fractured at a rate of 80 barrels per minute (BPM). To induce a signal (pressure pulse), one or more frac pumps may decrease the pump rate for a period of time, such as a decrease of 20 barrels per minute (BPM) for 30 seconds when hydraulic fluid is being pumped down the treatment well. The pressure data at the treatment well and the offset wells may be recorded with respect to time. If one or more of the offset wells show a decrease (temporary or continuous) in pressure after a period of time, the respective offset wells may be experiencing well connectivity from the hydraulic fracturing operations occurring on the treatment well. In some implementations, the signals may be continuously and/or intermittently induced throughout the hydraulic fracturing of the treatment well.

In some implementations, the arrival time of the response signal in the offset wells (if detected) may be utilized to determine the total travel time of the pressure pulse. For example, the travel time of the pressure pulse through the subsurface formation, and thus the wave speed of the pressure pulse may be determined based on the respective wave speed of the pressure pulse and the respective wellbore dimensions of the treatment well and offset wells. In some implementations, the wave speed of the pressure pulse through the subsurface formation may be utilized to determine the fracture length.

Furthermore, the relationship between the treatment well, offset wells, and fracture system may be characterized by a multi-well model comprising models of the treatment well, offset wells, fracture system, and near wellbore for both the treatment well and offset wells. In some implementations, parameters such as capacitance, inductance, resistance, etc. for the respective multi-well model components may be determined. Moreover, fracture system properties, such as the fracture system conductivity, may be determined based on the well system parameters.

In some implementations, when it is determined that one or more offset wells are in hydraulic communication with the treatment well, and the fracture properties are known (fracture length, fracture conductivity, etc.), operations may be performed to determine if the well connectivity is impacting the effective of the hydraulic operations. For example, when well connectivity is detected, the fluid loss rate may be determined to indicate if the hydraulic fluid being pumped into the treatment well is generating fractures in the subsurface formation, or instead at least partially flowing to lower pressured zones (such as a depleted zone surrounding an offset well). In some implementations, if the fluid loss rate exceeds a threshold that indicates there is a decrease in hydraulic fracturing efficiency (i.e., less energy is being applied to the subsurface formation to generate fractures in the rock), then one or more hydraulic fracturing operations and/or attributes may be performed, modified, etc. to mitigate the fluid loss and increase the hydraulic fracturing efficiency. For example, the hydraulic fracturing operations may include altering the pump rate, modifying the proppant, adding diverters to the hydraulic fracturing fluid, etc. in attempts to reduce the fluid loss rate and return to generating fractures in the subsurface formation. In some implementations, the sensors on the offset wells that have experienced well connectivity may be monitored to determine the efficacy of the hydraulic operations being performed. For example, a change in pressure on an offset well may indicate the hydraulic fracturing was effective, and the hydraulic fluid is generating new fractures in the subsurface formation for the treatment well.

Example System

FIG. 1 is an illustration depicting an example multi-well system, according to some implementations. In particular, FIG. 1 is a schematic of a multi-well system 100 that includes a wellbore 102 and a wellbore 108 in a subsurface formation 101. The wellbore 102 includes casing 106 and a number of perforations 190A-190H being made in the casing 106 at different depths to allow reservoir fluids (i.e., oil, water, and gas) from the subsurface formation 101 to flow into the wellbore 102. Similarly, the wellbore 108 includes casing 110 and a number of perforations 180A-180H being made in the casing 110 to allow reservoir fluids (i.e., oil, water, and gas) from the subsurface formation 101 to flow into the wellbore 108. During hydraulic fracturing operations of the wellbores 102 and/or 108, fracturing fluid, with or without sand, may be pumped into the subsurface formation 101, via the perforations 190A-190H and perforations 180A-180H, to hydraulically fracture the rock such that reservoir fluid may flow into the wellbore 102, 108, respectfully.

In some implementations, one or more sensors may be positioned to a wellbore to obtain measurements while an offset well is being hydraulically fractured. For example, a pressure sensor 132 may be positioned proximate the wellhead 114 to measure the pressure of the wellbore 102 while the wellbore 102 is hydraulically fractured and a pressure sensor 130 may be positioned proximate the wellhead 116 to measure the pressure of the wellbore 108 while the wellbore 102 is hydraulically fractured. Although FIG. 1 depicts a pressure sensors 130, 132 positioned at the surface 111, the pressure sensors 130, 132 may be positioned at any suitable location, such as internally in the wellbore 102, 108, respectively, externally ported to the casing 106, 110, respectively, etc. Additionally, the pressure sensors 130, 132 may be any suitable device capable of measuring pressure such as a pressure transducer, fiberoptic cables, etc.

The wellbore 102 may include one or more hydraulic fracturing components 120 configured to generate a signal in the fracturing fluid in the wellbore 102 during hydraulic fracturing operations. The signal may include a pressure pulse, such as a pressure drop or pressure increase. The one or more hydraulic fracturing components 120 may include one or more hydraulic fracturing pumps, one or more pressure relief valves, etc. The pressure sensor 132 may be configured to measure the time series of pressure to capture the signal generated by the one or more hydraulic fracturing components 120. In some implementations, if there is well interference between the wellbore 102 and the wellbore 108, the signal may be detected by the pressure sensor 130 as a response signal.

Figure 4:
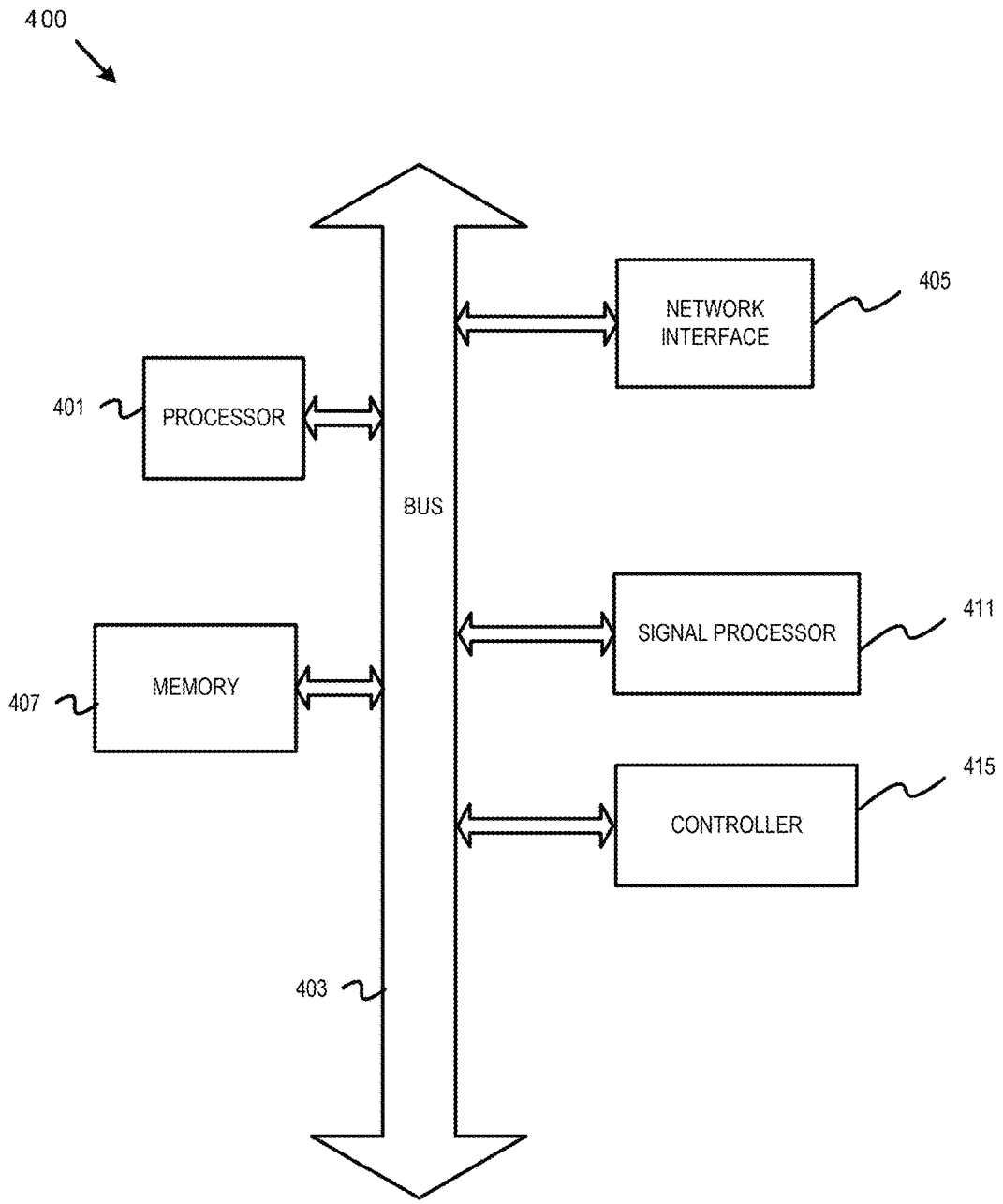
FIG. 4 is a block diagram depicting an example computer, according to some implementations.

A computer 170 may be communicatively coupled to the multi-well system 100. The computer 170 may include a signal processor to perform various signal processing operations on the multi-well system 100. The computer 170 may have one or more processors and a memory device to analyze the measurements and graphically represent analysis results on a display device. The computer 170 may include machine-readable instructions that, when executed by a processor, induce an excitement via the one or more hydraulic fracturing components 120, detect the response signal via the pressure sensor 130, and determine one or more fracture properties as described herein based on the travel times of the excitement through the subsurface formation 101. Although FIG. 1 depicts a system with multiple wellbores, embodiments described herein may also be applicable to other systems such as a single well system, multiple pads, etc. An example of the computer 170 is depicted in FIG. 4, and further described below.

The multi-well systems described in FIG. 1 may represent the method of a zipper frac completion. Detection of well connectivity and mitigation of fluid loss may be applicable to all types of completions. For example, well connectivity detection may be performed when an entire lateral of a wellbore has been or is currently being hydraulically fractured, multiple pads are being hydraulically fractured, multiple frac spreads are performing the hydraulic fracturing operations, etc.

Example Operations

Examples operations are now described.

Figure 2:
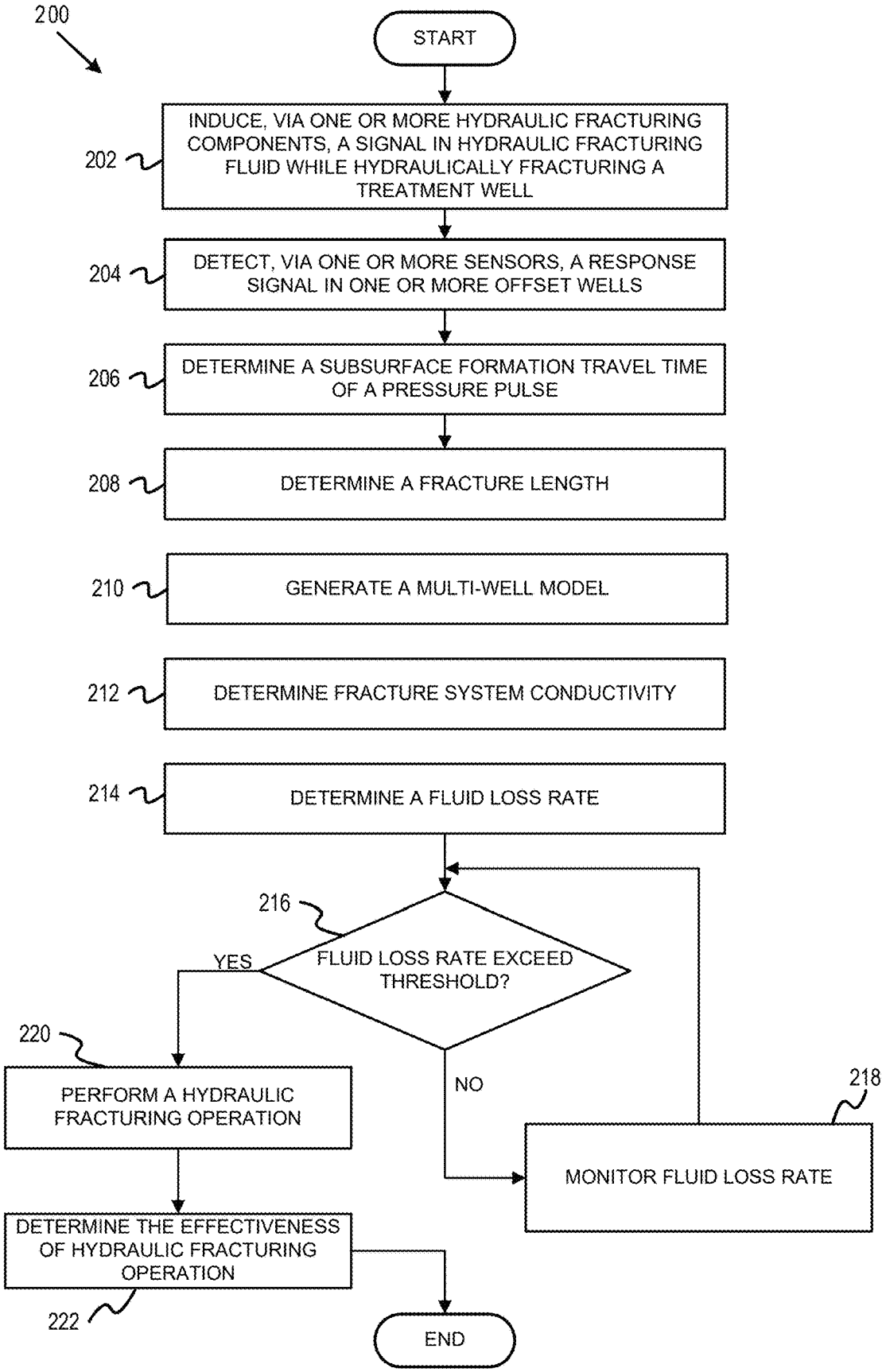
FIG. 2 is a flowchart depicting example operations for detecting well connectivity and determining fracture system properties, according to some implementations.

FIG. 2 is a flowchart depicting example operations for detecting well connectivity and determining fracture system properties, according to some implementations. FIG. 2 includes a flowchart 200 for inducing signals in the hydraulic fracturing fluid of a treatment well during hydraulic fracturing operations, detecting response signals in offset wells and utilizing the measurements to detect well connectivity and determine the fracture system properties between the wells. The operations of the flowchart 200 are described in reference to the computer 170 of FIG. 1. The operations of the flowchart 200 begin at block 202.

At block 202, the processor of the computer 170 may induce, via one or more hydraulic fracturing components, a signal in the hydraulic fracturing fluid while hydraulically fracturing a treatment well. When hydraulically fracturing a stage of a wellbore, hydraulic fracturing fluid may be pumped into the wellbore. A signal may be induced in this hydraulic fracturing fluid as it is pumped downhole. The signal may be a pressure pulse achieved by methods such as a change in the pump rate, injecting energy into the hydraulic fluid via an electrical discharge, etc. For example, fluid may be pumped into a well at approximately 80 barrels per minute (BPM) when hydraulically fracturing a stage. The rate may be decreased by a specified amount for a period of time to induce a pressure pulse in the hydraulic fracturing fluid, such as 10 BPM for 15 seconds. The rate decrease may induce a temporary reduction in the pressure at the surface, which may then propagate downhole and into the fluid within the subsurface formation. One or more sensors positioned proximate the well, such as at the wellhead, on one or more frac pumps, etc. may measure the time series of the pressure on the treatment well. The signal may be generated by hydraulic fracturing components such as one or more frac pumps, one or more valves, one or more components configured to generate an electrical discharge, etc.

At block 204, the processor of the computer 170 may detect, via one or more sensors, a response signal in one or more offset wells. One or more offset wells may be drilled proximate the treatment well in the same subsurface formation. In some implementations, the fracture system generated by the treatment well may interact with the fracture system generated by one or more offset wells. Accordingly, hydraulic communication may be established between the treatment well and respective offset wells. This well connectivity may affect hydraulic fracturing effectiveness of the treatment well, future performance of the treatment well, and/or performance of the offset wells.

In some implementations, the one or more offset wells may be configured with one or more sensors, such as a pressure sensor. The pressure sensors may be positioned in locations such as the wellhead of an offset well, inside the casing of the offset well, externally mounted to the casing of the offset well, etc. Each of the sensors may be configured to measure the time series of pressure in the respective offset well. If there is well connectivity between the treatment well and one or more offset wells, the signal (generated in block 202) may propagate through the subsurface formation and into said offset wells to generate a response signal in the offset wells, measured by the sensors of the respective offset well.

For example, a pressure pulse may be induced in a treatment well. The pressure pulse may propagate down the treatment well and out into the fluid within subsurface formation. Eventually, over a period of time, the pressure pulse may propagate into the fluid within an offset well that is hydraulically connected with the treatment well. The pressure pulse may propagate up (i.e., towards the surface) the fluid in the offset well and be measured by the sensors. In this example implementation, the measurement may be a temporary decrease in pressure due to the pressure pulse induced in the treatment well. This response signal measured by the sensors may indicate well connectivity between the treatment well and offset well. The response signal may also include an oscillatory response in the pressure signature or any other suitable response in the pressure measurements that indicate well connectivity. In some implementations, the response signal may include multiple pressure signatures described above. In some implementations, there may be well connectivity between a treatment well and multiple offset wells. The well connectivity may occur in parent-child well configurations, zipper frac operations, simulfrac operations, etc.

At block 206, the processor of the computer 170 may determine a subsurface formation travel time of a pressure pulse. The difference between the time at which the signal was induced at the treatment well and the arrival time of the response signal in an offset well may be the total travel time of the pressure pulse. The total travel time may be a summation of the travel time in the treatment well, the travel time in the offset well, and the travel time in the subsurface formation (i.e., the subsurface formation travel time). By knowing the wellbore dimensions of the treatment well and offset well, the time corresponding to wellbore travel (travel time in the treatment well and the travel time in the offset well) may be removed to determine the subsurface formation travel time. For example, the wave speed, represented by a, may be determined (shown below in Equation 1) as follows:

$$\frac{1}{a^2} = \frac{d\rho}{dP} + \frac{\rho}{A}\frac{dA}{dP} \tag{1}$$

where ρ is the density of the fluid, P is the pressure, and A is the cross sectional area. Equation 1 may be reconfigured to determine the wave speed in a wellbore (shown below in Equation 2):

$$a^2 = \frac{1}{\frac{\rho}{K_f} + (1 - v^2)\frac{\rho D}{Et}} \tag{2}$$

where $K_f$ is the coefficient of stiffness, v is the Poisson's ratio, D is the inside diameter of the casing, E is the Young's modulus, and t is the thickness of the casing. Given the wave speed of the pressure pulse in the treatment well and the offset well, via Equation 2, the subsurface travel time may be determined as follows (using Equation 3 below):

$$\text{Total Travel Time} = \frac{MD_{Trt}}{a_{Trt}} + \frac{MD_{Off}}{a_{Off}} + \text{Subsurface Travel Time} \tag{3}$$

Where $MD_{Trt}$ is the measured depth of the treatment well, $MD_{off}$ is the measured depth of the offset well, $a_{Trt}$ is the wave speed of the pressure pulse in the treatment well, and $a_{off}$ is the wave speed of the pressure pulse in the offset well.

At block 208, the processor of the computer 170 may determine a fracture length. The fracture length may be one of a plurality of properties of the fracture system between the treatment well and the offset well that is hydraulically connected to the treatment well. In some implementations, the wave speed of the pressure pulse through the subsurface formation (i.e., through the fluid in the fractures of the subsurface formation) may be approximated as the wave speed of the hydraulic fracturing fluid. In some implementations, if an estimate of fracture width and the fracture height is available, then the wave speed through the fracture system may be determined as follows be reconfiguration of Equation 1 (using Equation 4 below):

$$a^2 = \frac{\pi w G}{2\rho h_f + (1 - v^2)\frac{\rho D}{Et}} \tag{4}$$

where w is the fracture width, G is the shear modulus, and $h_f$ is the fracture height. With wave speed of the pressure pulse in the fracture system (from Equation 4) and the subsurface travel time of the pressure pulse (from Equation 3), the fracture length may be determined. For example, the wave speed may be the time it takes the pressure pulse to travel a distance. With the time (subsurface formation travel time) and the speed (wave speed) known, the distance may be solved for, thus determining the fracture length.

At block 210, the processor of the computer 170 may generate a multi-well model. The multi-well model may distinguish the relationship between the treatment well, the near wellbore components of the treatment well, the fracture system, the near wellbore components of the offset wells, and the offset wells.

Figure 3:
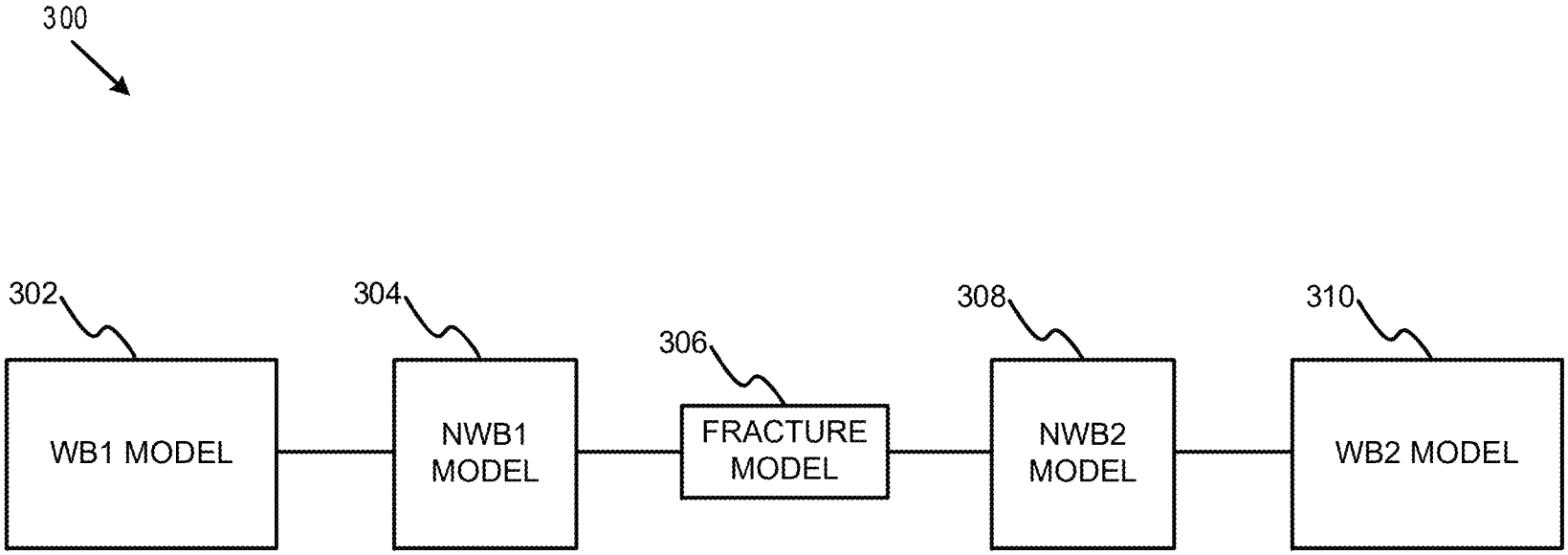
FIG. 3 is a block diagram depicting a multi-well model, according to some implementations.

To help illustrate, FIG. 3 is a block diagram depicting a multi-well model, according to some implementations. In particular, FIG. 3 includes a multi-well model 300 that includes a WB1 (wellbore 1) model 302 (representing the treatment well), a NWB1 (near-wellbore 1) model 304 (representing the near wellbore components of the treatment well), a fracture model 306, a WB2 (wellbore 2) model 308 (representing the offset well), and a NWB2 (near-wellbore 2) model 310 (representing the near wellbore components of the offset well). Although the multi-well model 300 depicts models for a single offset well, the multi-well model 300 may include models for more than one offset well. NWB1 model 304 and NWB2 model 308 may be the area in the subsurface formation that may include perforations, skin, etc. where the flow of hydraulic fluid may be impacted when flowing into the offset well from the fracture system and/or into the fracture system from the treatment well.

The components of the multi-well model 300 (models 302-310) may be modeled using the following (as shown below in Equations 5-9):

$$C\frac{\delta H}{\delta t}+\frac{\delta Q}{\delta x}=0 \tag{5}$$

$$I\frac{\delta Q}{\delta t}+\frac{\delta H}{\delta x}+RQ=0 \tag{6}$$

$$C=\frac{gA}{a^2} \tag{7}$$

$$I=\frac{I}{gA} \tag{8}$$

$$R=\frac{f|Q|}{2gDA^2} \tag{9}$$

where C is the capacitance, H is the head, t is the time, Q is the flowrate, x is the spatial dimension (measured depth), I is the inductance, R is the resistance, g is gravity, f is the friction coefficient, D is diameter, and A is the area. In some implementations, the variables in Equations 5-9 may be known for the WB1 model 302 and the WB2 model 310. The fracture parameters R, I, and C may be unknown.

In some implementations, simplifications may be applied to each of the models. For example, the flow rate, Q, for the WB2 310 may be low (such as less than 1 BPM). This may be due to the fluid losing momentum while flowing through the fractures, offset well being shut in, etc. Accordingly, there may be approximately no flow into said offset well. Thus, resistance in the NWB2 model 308 is negligible and the friction coefficient for the offset well (WB2 310 model) may be ignored. Accordingly, the remaining unknown variables of the multi-well model may include the resistance, R, of the NWB1 model 304 and the fracture parameters R, I, and C of the fracture model 306.

In some implementations, an inversion process may be utilized to determine the aforementioned unknowns. For example, the inversion process may comprise predicting the response signal at the surface of the offset wellbore (predicted pressure) based on the measured response signal (measured pressure) and the fracture parameters R, I, and C. A forward model may generate a predicted pressure based on the fracture parameters. The difference in the predicted pressure and the measured pressure may be characterized by a cost function, such as the sum of the square of the difference between the predicted pressure and the measured pressure. The inversion process may iteratively adjust the fracture parameters to minimize the cost function and thus, determine the fracture parameters R, I, and C. The same procedure may be utilized to determine the resistance of the NWB1 model 304. Any suitable inversion process may be utilized to determine the aforementioned unknown variables within the multi-well model 300.

At block 212, the processor of the computer 170 may determine fracture system conductivity. With the resistance of the fracture system determined via the multi-well model 300 of FIG. 3 (described in block 210), the conductance of the fractures between the treatment well and the offset wells may be determined as the reciprocal of the fracture system resistance.

Additionally, the fracture system parameters R, I, and C determined in block 210 may be associated with fracture geological features such as fracture height, fracture shape, etc. For example, if you assume the cross sectional area of the fracture is elliptical, then R, I, and C may provide shape properties of the elliptical shaped fracture.

At block 214, the processor of the computer 170 may determine a fluid loss rate. From the time a response signal is detected in one or more offset wells and onwards, the hydraulic fracturing fluid pumped in the treatment well from that time forward may not be generating new fractures in the subsurface formation, or be generating less fractures than when there was no well connectivity with one or more offset wells. Rather, the hydraulic fracturing fluid may flow through the subsurface formation, via the fracture system, to lower-pressured regions, such as a depleted region proximate an offset well. This may result in a decrease in hydraulic fracturing efficiency. Accordingly, the fluid loss rate may indicate how inefficient the hydraulic fracturing operations may be since establishing well connectivity with the offset wells. For example, a stage may be planned to be hydraulically fractured at a rate of 80 BPM. During hydraulic fracturing operations it is determined that there is well connectivity with an offset well (indicated by a response signal). It may be determined that the fluid loss rate is 40 BPM, indicating that only 50% of the energy is being utilized to generate fractures in the subsurface formation.

The fluid loss rate may be determined based on the pressure differential across the fracture system between the treatment well and the offset wells, and the fracture system conductivity determined in block 212. For example, the fluid loss rate, represented by Q, may be determined as follows (as shown in Equation 10 below):

$$Q=-\frac{k}{\mu}\left(\frac{\Delta P}{L}\right)$$

where k is the fracture system conductivity (determined in block 212), μ is the fluid velocity, L is the fracture length (determined in block 208), and ΔP is the differential pressure between the treatment wellbore and the offset wellbore.

At block 216, the processor of the computer 170 may determine if the fluid loss rate exceeds a threshold. A threshold may be set to indicate if the hydraulic fracturing operations are decreasing in efficiency. The threshold may be any suitable measurement such as a percentage of the planned pump rate for the current stage, a specific rate, etc. For example, the threshold may be 10% of the pump rate. Thus, if the fluid loss rate is greater than 10% of the pump rate of the hydraulic fracturing fluid being pumped into the treatment well, then hydraulic fracturing operations may not be efficient and not enough fractures are being generated for the treatment well. Alternatively, or additionally, the threshold may be set at 10 BPM. Thus, if the fluid loss rate is greater than 10 BPM, then hydraulic fracturing efficiency may be decreasing. If the fluid loss rate exceeds the threshold, then operations proceed to block 220. Otherwise, operations proceed to block 218.

At block 218, the processor of the computer 170 may monitor the fluid loss rate. If the fluid loss rate indicates that the energy being applied to the subsurface formation is sufficient, then the fluid loss rate may be monitored and iteratively checked against the threshold to ensure the hydraulic fracturing operations remain efficient.

At block 220, the processor of the computer 170 may perform a hydraulic fracturing operation. The hydraulic fracturing operation may be a corrective action to reduce the well connectivity and ultimately reduce the fluid loss rate. The hydraulic fracturing operations may include altering the pump rate, modifying the proppant and/or proppant concentrations, dropping diverter to divert the hydraulic fracturing fluid to other perforations, etc.

At block 222, the processor of the computer 170 may determine the effectiveness of the hydraulic fracturing operation. In some implementations, the one or more sensors positioned on the offset wells may be utilized to determine the efficacy of the hydraulic fracturing operation performed in block 220. Once performed, the pressure measurements from the one or more sensors may be observed for any change in the pressure signature of the offset well that may indicate that the fluid loss rate is decreasing and/or is zero. For example, the pressure on the offset well may decrease after diverter is dropped in the treatment well, indicating that the hydraulic fracturing fluid has been diverted to new rock surrounding the treatment well to fracture said rock rather than flowing to the depleted zones surrounding the offset well. In some implementations, if there is no change in the pressure signature on the offset wells, then other corrective actions may be taken such as implementing a different hydraulic fracturing operations than what was performed in block 220, adjusting the hydraulic fracturing operation that was performed in block 220, etc.

While the aspects of the disclosure are described with reference to various implementations and exploitations, it will be understood that these aspects are illustrative and that the scope of the claims is not limited to them. In general, techniques for detecting well connectivity and determining fracture properties described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Example Computer

FIG. 4 is a block diagram depicting an example computer, according to some implementations. FIG. 4 depicts a computer 400 for classification of system tracts. The computer 400 includes a processor 401 (possibly including multiple processors, multiple cores, multiple nodes, and/or implementing multi-threading, etc.). The computer 400 includes memory 407. The memory 407 may be system memory or any one or more of the above already described possible realizations of machine-readable media. The computer 400 also includes a bus 403 and a network interface 405. The computer 400 can communicate via transmissions to and/or from remote devices via the network interface 405 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

The computer 400 also includes a signal processor 411 and a controller 415 which may perform the operations described herein. For example, the signal processor 411 may obtain measurements of a treatment well and/or the offset wells, such as the time series pressure measurements to indicate if there is well connectivity between the treatment well and one or more offset wells. Additionally, the signal processor may determine fracture properties based on the measurements and the fluid loss rate. The controller 415 may perform a hydraulic fracturing operation based on the fluid loss rate. The signal processor 411 and the controller 415 can be in communication. Any one of the previously described functionalities may be partially (or entirely) implemented in hardware and/or on the processor 401. For example, the functionality may be implemented with an application specific integrated circuit, in logic implemented in the processor 401, in a co-processor on a peripheral device or card, etc. Further, realizations may include fewer or additional components not illustrated in FIG. 4 (e.g., video cards, audio cards, additional network interfaces, peripheral devices, etc.). The processor 401 and the network interface 405 are coupled to the bus 403. Although illustrated as being coupled to the bus 403, the memory 407 may be coupled to the processor 401.

Example Implementations

Implementation #1: A method comprising: inducing, via one or more hydraulic fracturing components, a first signal in hydraulic fracturing fluid in a treatment well while hydraulically fracturing the treatment well, wherein the treatment well is formed in a subsurface formation; and detecting, via one or more sensors, a response signal in one or more offset wells formed in the subsurface formation based on the first signal, wherein the response signal indicates well connectivity between the treatment well and the one or more offset wells.

Implementation #2: The method of Implementation #1 further comprising: determining one or more fracture properties based on the first signal and the response signal.

Implementation #3: The method of Implementation #2, wherein the one or more fracture properties include fracture length and fracture system conductivity.

Implementation #4: The method of Implementation #3 further comprising: determining a first travel time of the first signal in the treatment well based on wellbore dimensions of the treatment well and a wave speed of the first signal in the treatment well; determining a second travel time of the response signal in the one or more offset wells well based on wellbore dimensions of the one or more offset wells and the wave speed of the response signal in the one or more offset wells; and determining a subsurface formation travel time of a pressure pulse based on the first travel time and the second travel time.

Implementation #5: The method of Implementation #4 further comprising; determining the wave speed of a pressure pulse in the subsurface formation; and determining the fracture length based on the wave speed of the pressure pulse in the subsurface formation and the subsurface formation travel time.

Implementation #6: The method of Implementation #3 or 4 further comprising: determining, via an inversion process, a fracture system resistance via a multi-well model; and determining the fracture system conductivity based on fracture system resistance.

Implementation #7: The method of any one or more of Implementations #1-6 further comprising: determining a fluid loss rate based on a fracture length and a fracture conductivity; and performing a hydraulic fracturing operation when the fluid loss rate exceeds a threshold.

Implementation #8: The method of Implementation #7 further comprising: determining an effectiveness of the hydraulic fracturing operation based on a pressure signature measured on the one or more offset wells when the hydraulic fracturing operation is performed.

Implementation #9: The method of any one or more of Implementations #1-8, wherein the first signal is a pressure pulse in the hydraulic fracturing fluid, and wherein the one or more hydraulic fracturing components includes one or more frac pumps.

Implementation #10: A system comprising; a treatment well formed in a subsurface formation; one or more offset wells formed in the subsurface formation; a processor; and a computer-readable medium having instructions stored thereon that are executable by the processor, the instructions including, instructions to induce, via one or more hydraulic fracturing components, a first signal in hydraulic fracturing fluid in the treatment well while hydraulically fracturing the treatment well; and instructions to detect, via one or more sensors, a response signal in one or more offset wells based on the first signal, wherein the response signal indicates well connectivity between the treatment well and the one or more offset wells.

Implementation #11: The system of Implementation #10 further comprising: instructions to determine one or more fracture properties based on the first signal and the response signal, wherein the one or more fracture properties include fracture length and fracture system conductivity.

Implementation #12: The system of Implementation #11 further comprising: instructions to determine a first travel time of the first signal in the treatment well based on wellbore dimensions of the treatment well and a wave speed of the first signal in the treatment well; instructions to determine a second travel time of the response signal in the one or more offset wells well based on wellbore dimensions of the one or more offset wells and the wave speed of the response signal in the one or more offset wells; and instructions to determine a subsurface formation travel time of a pressure pulse based on the first travel time and the second travel time.

Implementation #13: The system of Implementation #12 further comprising; instructions to determine the wave speed of a pressure pulse in the subsurface formation; and instructions to determine the fracture length based on the wave speed of the pressure pulse in the subsurface formation and the subsurface formation travel time.

Implementation #14: The system of Implementation #11 or 12 further comprising: instructions to determine, via an inversion process, a fracture system resistance via a multi-well model; and instructions to determine the fracture system conductivity based on fracture system resistance.

Implementation #15: The system of any one or more of Implementations #10-14 further comprising: instructions to determine a fluid loss rate based on a fracture length and a fracture conductivity; and instructions to perform a hydraulic fracturing operation when the fluid loss rate exceeds a threshold.

Implementation #16: A non-transitory, computer-readable medium having instructions stored thereon that are executable by a processor, the instructions comprising: instructions to induce, via one or more hydraulic fracturing components, a first signal in hydraulic fracturing fluid in a treatment well while hydraulically fracturing the treatment well, wherein the treatment well is formed in a subsurface formation; and instructions to detect, via one or more sensors, a response signal in one or more offset wells formed in the subsurface formation based on the first signal, wherein the response signal indicates well connectivity between the treatment well and the one or more offset wells.

Implementation #17: The non-transitory, computer-readable medium of Implementation #16 further comprising: instructions to determine one or more fracture properties based on the first signal and the response signal, wherein the one or more fracture properties include fracture length and fracture system conductivity.

Implementation #18: The non-transitory, computer-readable medium of Implementation #17 further comprising: instructions to determine a first travel time of the first signal in the treatment well based on wellbore dimensions of the treatment well and a wave speed of the first signal in the treatment well; instructions to determine a second travel time of the response signal in the one or more offset wells well based on wellbore dimensions of the one or more offset wells and the wave speed of the response signal in the one or more offset wells; and instructions to determine a subsurface formation travel time of a pressure pulse based on the first travel time and the second travel time.

Implementation #19: The non-transitory, computer-readable medium of Implementation #18 further comprising: instructions to determine the wave speed of a pressure pulse in the subsurface formation; and instructions to determine the fracture length based on the wave speed of the pressure pulse in the subsurface formation and the subsurface formation travel time.

Implementation #20: The non-transitory, computer-readable medium of Implementation #17 or 18 further comprising: instructions to determine, via an inversion process, a fracture system resistance via a multi-well model; and instructions to determine the fracture system conductivity based on fracture system resistance.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A method comprising:

inducing, via one or more hydraulic fracturing components, a first signal in hydraulic fracturing fluid in a treatment well while hydraulically fracturing the treatment well, wherein the treatment well is formed in a subsurface formation;

detecting, via one or more sensors, a response signal in one or more offset wells formed in the subsurface formation based on the first signal, wherein the response signal indicates well connectivity between the treatment well and the one or more offset wells;

generating a multi-well model that represents a relationship between the treatment well, a fracture system, and the one or more offset wells, wherein the multi-well model is configured to determine one or more fracture properties based on the first signal and the response signal; and determining a fluid loss rate based on the one or more fracture properties.

2. The method of claim 1, wherein the one or more fracture properties include fracture length and fracture system conductivity.

3. The method of claim 2 further comprising:

determining a first travel time of the first signal in the treatment well based on wellbore dimensions of the treatment well and a wave speed of the first signal in the treatment well;

determining a second travel time of the response signal in the one or more offset wells well based on wellbore dimensions of the one or more offset wells and the wave speed of the response signal in the one or more offset wells; and determining a subsurface formation travel time of a pressure pulse based on the first travel time and the second travel time.

4. The method of claim 3 further comprising;

determining the wave speed of the pressure pulse in the subsurface formation; and determining the fracture length based on the wave speed of the pressure pulse in the subsurface formation and the subsurface formation travel time.

5. The method of claim 2 further comprising:

determining, via an inversion process, a fracture system resistance via the multi-well model; and determining the fracture system conductivity based on fracture system resistance.

6. The method of claim 1 further comprising:

determining the fluid loss rate based on a fracture length and a fracture conductivity; and performing a hydraulic fracturing operation when the fluid loss rate exceeds a threshold.

7. The method of claim 6 further comprising:

determining an effectiveness of the hydraulic fracturing operation based on a pressure signature measured on the one or more offset wells when the hydraulic fracturing operation is performed.

8. The method of claim 1, wherein the first signal is a pressure pulse in the hydraulic fracturing fluid, and wherein the one or more hydraulic fracturing components includes one or more frac pumps.

9. A system comprising;

a treatment well formed in a subsurface formation;

one or more offset wells formed in the subsurface formation;

a processor; and a computer-readable medium having instructions stored thereon that are executable by the processor, the instructions including, instructions to induce, via one or more hydraulic fracturing components, a first signal in hydraulic fracturing fluid in the treatment well while hydraulically fracturing the treatment well; and instructions to detect, via one or more sensors, a response signal in the one or more offset wells based on the first signal, wherein the response signal indicates well connectivity between the treatment well and the one or more offset wells;

instructions to generate a multi-well model that represents a relationship between the treatment well, a fracture system, and the one or more offset wells, wherein the multi-well model is configured to determine one or more fracture properties based on the first signal and the response signal; and instructions to determine a fluid loss rate based on the one or more fracture properties.

10. The system of claim 9, wherein the one or more fracture properties include fracture length and fracture system conductivity.

11. The system of claim 10 further comprising:

instructions to determine a first travel time of the first signal in the treatment well based on wellbore dimensions of the treatment well and a wave speed of the first signal in the treatment well;

instructions to determine a second travel time of the response signal in the one or more offset wells well based on wellbore dimensions of the one or more offset wells and the wave speed of the response signal in the one or more offset wells; and instructions to determine a subsurface formation travel time of a pressure pulse based on the first travel time and the second travel time.

12. The system of claim 11 further comprising;

instructions to determine the wave speed of the pressure pulse in the subsurface formation; and instructions to determine the fracture length based on the wave speed of the pressure pulse in the subsurface formation and the subsurface formation travel time.

13. The system of claim 10 further comprising:

instructions to determine, via an inversion process, a fracture system resistance via the multi-well model; and instructions to determine the fracture system conductivity based on fracture system resistance.

14. The system of claim 9 further comprising:

instructions to determine the fluid loss rate based on a fracture length and a fracture conductivity; and instructions to perform a hydraulic fracturing operation when the fluid loss rate exceeds a threshold.

15. A non-transitory, computer-readable medium having instructions stored thereon that are executable by a processor, the instructions comprising:

instructions to induce, via one or more hydraulic fracturing components, a first signal in hydraulic fracturing fluid in a treatment well while hydraulically fracturing the treatment well, wherein the treatment well is formed in a subsurface formation;

instructions to detect, via one or more sensors, a response signal in one or more offset wells formed in the subsurface formation based on the first signal, wherein the response signal indicates well connectivity between the treatment well and the one or more offset wells; and instructions to generate a multi-well model that represents a relationship between the treatment well, a fracture system, and the one or more offset wells, wherein the multi-well model is configured to determine one or more fracture properties based on the first signal and the response signal; and instructions to determine a fluid loss rate based on the one or more fracture properties.

16. The non-transitory, computer-readable medium of claim 15, wherein the one or more fracture properties include fracture length and fracture system conductivity.

17. The non-transitory, computer-readable medium of claim 16 further comprising:

instructions to determine a first travel time of the first signal in the treatment well based on wellbore dimensions of the treatment well and a wave speed of the first signal in the treatment well;

instructions to determine a second travel time of the response signal in the one or more offset wells well based on wellbore dimensions of the one or more offset wells and the wave speed of the response signal in the one or more offset wells; and instructions to determine a subsurface formation travel time of a pressure pulse based on the first travel time and the second travel time.

18. The non-transitory, computer-readable medium of claim 17 further comprising:

instructions to determine the wave speed of the pressure pulse in the subsurface formation; and instructions to determine the fracture length based on the wave speed of the pressure pulse in the subsurface formation and the subsurface formation travel time.

19. The non-transitory, computer-readable medium of claim 16 further comprising:

instructions to determine, via an inversion process, a fracture system resistance via the multi-well model; and instructions to determine the fracture system conductivity based on fracture system resistance.

* * * * *